US005090925A

United States Patent [19]

Sato et al.

[11] Patent Number: 5,090,925

[45] Date of Patent: Feb. 25, 1992

[54] ELECTRICAL CONNECTOR FOR DIVERSITY ANTENNAS

[75] Inventors: Kensaku Sato; Akira Shirai, both of Tokyo, Japan

[73] Assignee: Hirose Electric Co., Ltd., Tokyo, Japan

[21] Appl. No.: 718,252

[22] Filed: Jun. 20, 1991

[30] Foreign Application Priority Data

Sep. 18, 1990 [JP] Japan ..... 2-97254[U]

[51] Int. Cl.[5] ..... H01R 13/00

[52] U.S. Cl. ..... 439/862

[58] Field of Search ..... 439/660, 284, 289, 290, 439/291, 816, 851, 852, 862

[56] References Cited

U.S. PATENT DOCUMENTS

| | | | |
|---|---|---|---|
| 3,742,430 | 6/1973 | Cairns et al. | 439/862 |
| 4,431,252 | 2/1984 | Cairns et al. | 439/862 |
| 4,720,274 | 1/1988 | Tackett et al. | 439/862 |

*Primary Examiner*—Joseph H. McGlynn

*Attorney, Agent, or Firm*—Kanesaka & Takeuchi

[57] ABSTRACT

An electrical connector includes a male electrical connector (2) having a plurality of male contact terminals (16, 18) and a plurality of male antennas connection terminals (22); a female electrical connector (3) having a plurality of female contact terminals (53) for contact with said male contact terminals and a plurality of female antennas connection terminals (65) for contact with said male antennas connection terminals; a terminal support portion (40) provided on front end of said terminal aperture for supporting a front end of said female contact terminal; and said female contact terminals having a stopper portion (57) in a middle portion thereof, a hook portion (58) behind said stopper portion, a contact strip (59) extending backwardly and upwardly from a front bottom end and then downwardly to form a V-shaped contact portion, with a free end of said contact strip engaged with said hook portion, and a front end (61) supported by said means when said female contact terminal is fitted into said terminal aperture.

1 Claim, 9 Drawing Sheets

ELECTRICAL CONNECTOR FOR DIVERSITY ANTENNAS

BACKGROUND OF THE INVENTION

1. Field of the Invention

The present invention relates to electrical connectors for establishing a contact between antennas connection terminals as well as between contact terminals.

2. Description of the Prior Art

Electrical connectors of this type are used to connect cables for transmitting signals to receivers from antennas which are mounted on moving objects such as automobiles. However, most of the conventional electrical connectors are used to connect a cable of a single antennas.

FIG. 25 shows such a conventional male connector 80 which includes an insulation housing 82 with a fitting cavity 83 having a pair of insulation walls 84. An antennas terminal mount 85 is provided on the upper left-hand corner of the insulation housing 82. A number of male terminals 86 are mounted at predetermined intervals on opposite sides of each insulation walls 84 for serving as signal terminals or power terminals. An antennas male terminal 87 is mounted on the antennas terminal mount 85.

In FIG. 26, the male connector 80 and a board 88 are mounted on a panel 89 with a screw 90 such that a contact pad 87*a* of the antennas male terminal 87 is brought into contact with the panel 89.

In FIGS. 27 and 28, a conventional female connector 81 includes an insulation housing 91 with two pairs of insulation walls 92. A number of female terminals 93 are mounted at predetermined intervals on the inner sides of each pair of insulation walls 92 for serving as power terminals or signal terminals. An antennas terminal mount 94 is provided on the upper right-hand corner of the insulation housing 91. An antennas female terminal 95 is mounted in the antennas terminal mount 94.

When the female connector 81 is connected to the male connector 80, the insulation walls 92 of the female connector 81 are fitted into the fitting cavity 83 of the terminals of the female connector 81 are brought into contact with those of the male connector 80 while the antennas female terminal 95 is brought into contact with the antennas male terminal 85.

However, the conventional electrical connector has ordinary spring contact terminals as the female terminals 93 and are merely inserted into terminal channels so that they reflex back upon contact with the male terminals 86, resulting in the low contact pressure. The front end of the female terminals 93 are prone to damage. When the contact pieces of the contact portion deformed under the pressure of a male terminal, they can be deformed beyond the elastic limits, making the deformation plastic.

SUMMARY OF THE INVENTION

Accordingly, it is an object of the invention to provide an electrical connector having contact terminals which do not flex back upon contact, thereby increasing the contact pressure.

It is another object of the invention to provide an electrical connector having contact terminals which have a protected front end.

It is still another object of the invention to provide an electrical connector which has a device for preventing a plastic deformation of the contact terminals, thus assuring a long service life.

According to the invention there is provided an electrical connector which includes a male electrical connector having a plurality of male contact terminals and a plurality of male antennas connection terminals; a female electrical connector having a plurality of female contact terminals for contact with the male contact terminals and a plurality of female antennas connection terminals for contact with the male antennas connection terminals; means provided on front end of the terminal aperture for supporting a front end of the female contact terminal; and the female contact terminals having a stopper portion in a middle portion thereof, a hook portion behind the stopper portion, a contact strip extending backwardly and upwardly from a front bottom end and then downwardly to form a V-shaped contact portion, with a free end of the contact strip engaged with the hook portion, and a front end supported by the means when the female contact terminal is fitted into the terminal aperture.

The above and other objects, features, and advantages of the invention will be more apparent from the following description when taken in conjunction with the accompanying drawings.

DESCRIPTION OF THE PREFERRED EMBODIMENT

Figure 1:
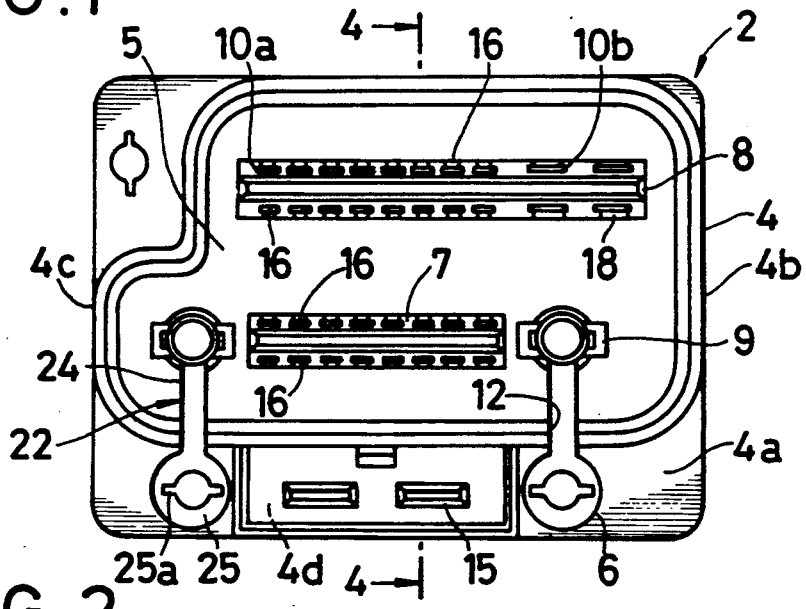
FIG. 1 is a top plan view of a male electrical connector for a diversity antennas according to an embodiment of the invention.
Figure 2:
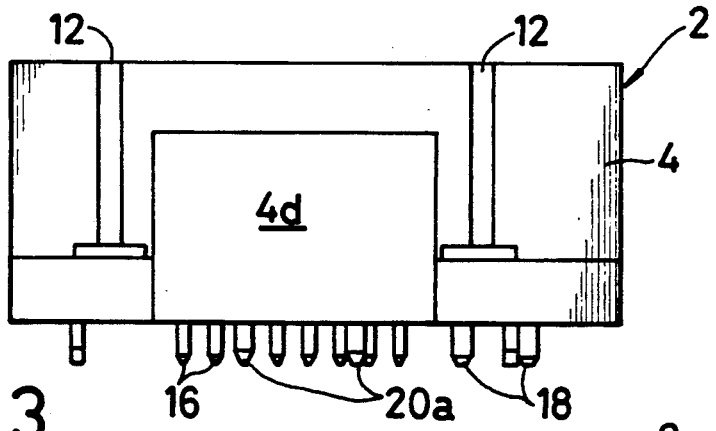
FIG. 2 is a front elevational view thereof.
Figure 3:
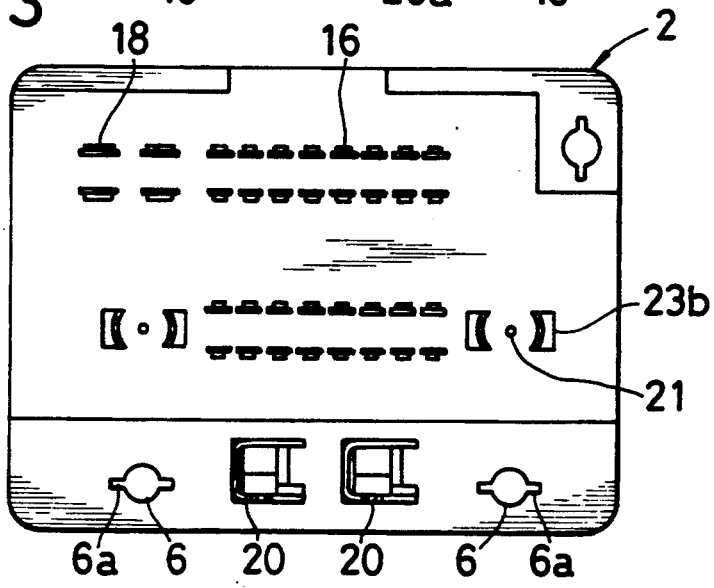
FIG. 3 is a bottom plan view thereof.

In FIGS. 1-3, a male connector 2 includes an insulation housing 4 which has a rectangular base 4*a* and a side wall 4*b* for defining a fitting cavity 5. The side wall 4*b* has an expanded section 4*c* making the fitting cavity 5 asymmetric. A fuse mount 4*d* is provided on the rectangular base 4*a* in front of the fitting cavity 5 and is made lower than the side wall 4*b*. A pair of mounting apertures 6 with a pair of slits 6*a* are provided on the rectangular base 4*a* across the fuse mount 4*d*. A short insulation wall 7 and a long insulation wall 8 extend upwardly from the rectangular base 4*a* and parallel with each other. A pair of antennas terminal mounts 9 are provided on the rectangular base 4*a* across the short insulation wall 7.

The leg portion 20*a* of the fuse terminal 20 is soldered to the power circuit conductor of a board. A fuse (not shown) is mounted on the fuse mount 4*d* of the male connector 2 by inserting its leg portion into the terminal apertures 15 so that they comes into contact with the fuse terminals 20. 16 signal terminal channels 10*a* and four power terminal channels 10*b* are formed at predetermined intervals on opposite sides of the long insulation wall 8 for receiving male signal contact terminals 16 and male power contact terminals 18, respectively, while 16 signal terminal channels 10*a* are formed at predetermined intervals on opposite sides of the short insulation wall 7 for receiving male signal contact terminals 16. The side wall 4*b* discontinues at a pair of openings 12 on the lines which include the antennas terminal mounts 9 and the mounting apertures 6.

Figure 4:
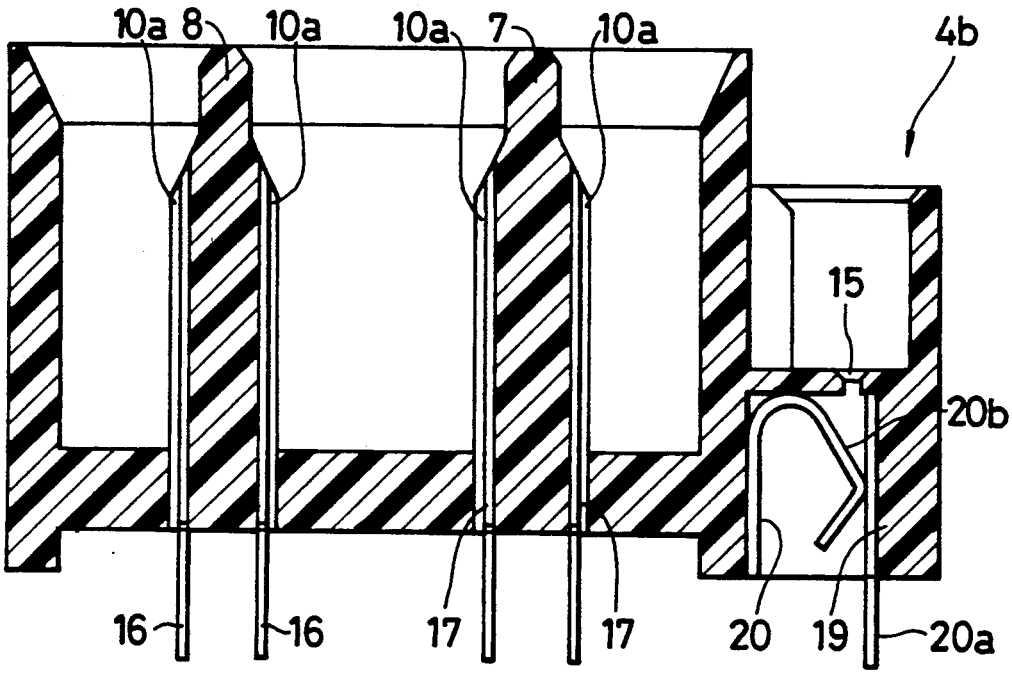
FIG. 4 is a sectional view taken along line 4—4 of FIG. 1.

As best shown in FIG. 4, the terminal channels 10*a* communicate with press fit apertures 17 in the rectangular base 4*a*. The male signal terminals 16 are fitted into the press fit apertures 17. A terminal mount 19 is provided on the bottom of the fuse mount 4*d* for receiving the fuse terminal 20.

Figure 4B:
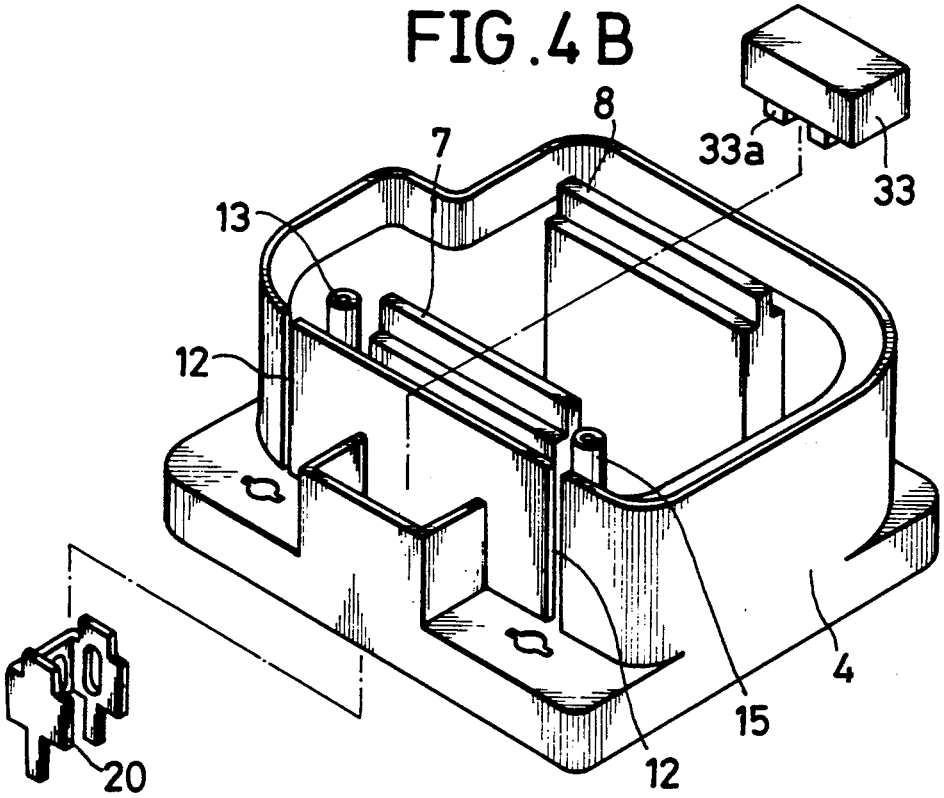
FIG. 4B is a top-front-side perspective view of an insulation housing for the male electrical connector.

In FIGS. 4 and 4B, a fuse 33 is mounted on the fuse mount 4*d* such that the leg portions 33*a* fit into the terminal apertures 15 and come into contact with the contact portions 20*b* of the fuse terminals 20.

Figure 5:
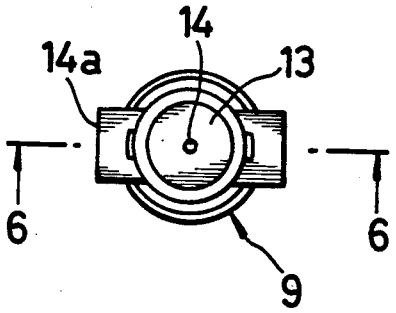
FIG. 5 is a top plan view of an antennas terminal mount for the male electrical connector.
Figure 6:
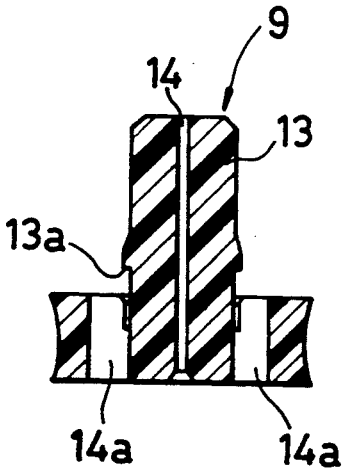
FIG. 6 is a sectional view taken along line 6—6 of FIG. 5.

In FIGS. 5 and 6, the antennas terminal mount 9 includes a core column 13 which has a central aperture 14 for receiving a central conductor and a pair of hooks 13*a* on the base portion. A pair of openings 14*a* are formed on opposite sides of the core column 13.

Figure 7:
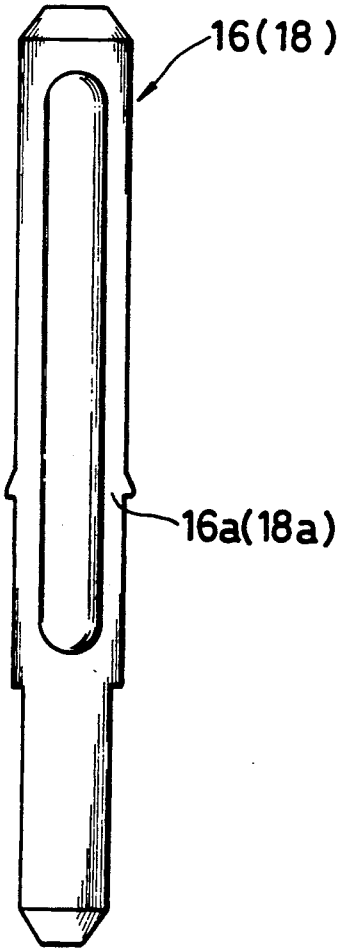
FIG. 7 is a top plan view of a signal or power male terminal for the male electrical connector.
Figure 8:
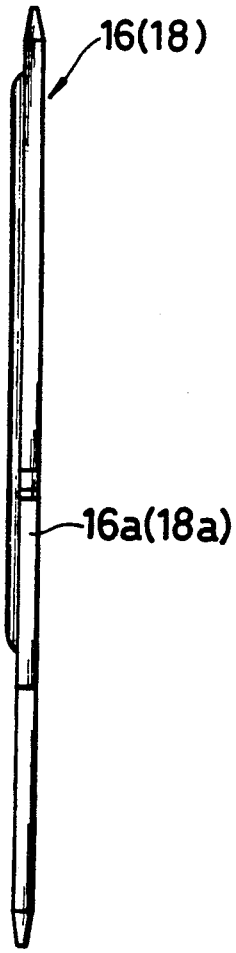
FIG. 8 is a side elevational view thereof.

In FIGS. 7 and 8, the signal or power contact ; terminal 16, 18 which is to be fitted in the terminal channel 10*a*, 10*b* has a press fit portion 16*a*, 18*a* to be press fitted into the press fit aperture 17.

Figure 9:
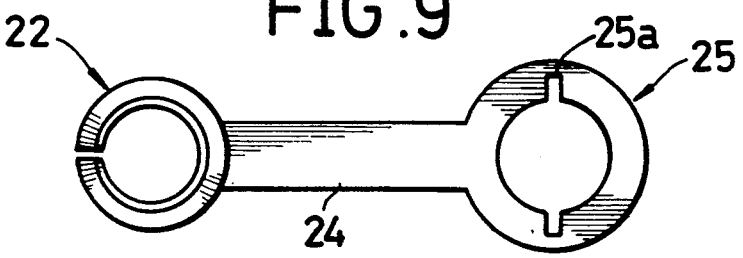
FIG. 9 is a top plan view of an antennas male terminal for the male electrical connector.
Figure 11:
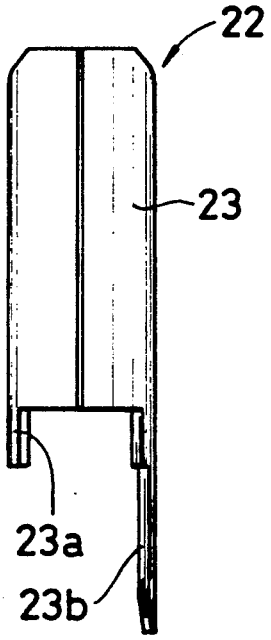
FIG. 11 is a rear elevational view thereof.
Figure 10:
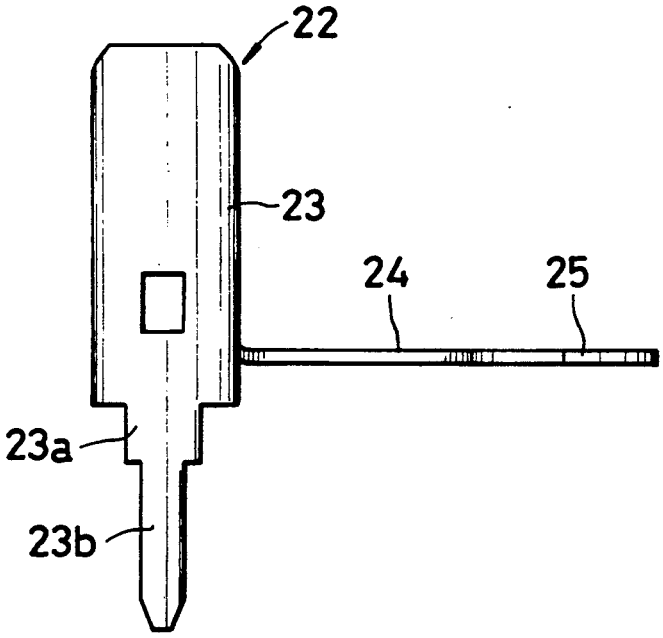
FIG. 10 is a side elevational view thereof.

In FIGS. 9-11, the antennas male terminal 22 has a cylindrical terminal body 23 which has press fit portion 23*a* and a leg portion 23*b*. A conductor portion 24 extends laterally from the terminal body 23 and terminates with a 10 ring portion 25 with a pair of slits 25*a*. As shown in FIG. the antennas male terminal 22 is affixed to the insulation housing 4 by fitting the terminal body 23 over the core column 13 while press fitting the leg portion 23*b* in the opening 14*a*. At the same time, the conductor portion 4 is fitted in the opening 12 of the side wall 4*b* while the ring portion 25 is placed on the mounting aperture 6.

Figure 12:
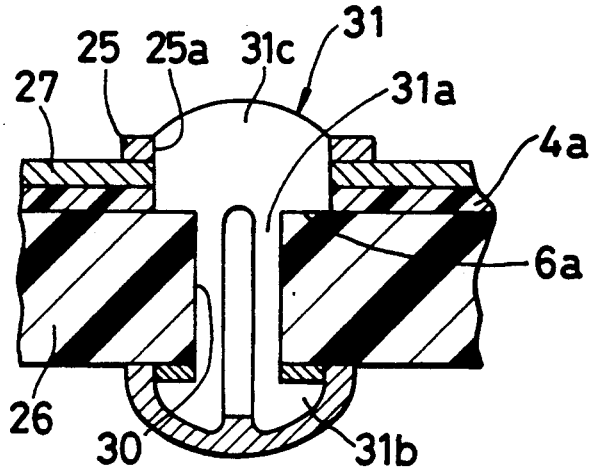
FIG. 12 is a sectional view of a mounting aperture of the male electrical connector.

In FIG. 12, the male connector 2 and a board 26 are mounted on a panel 27 by inserting the side wall 4*b* of the insulation housing 4 into an opening of the panel 27 so that the housing base 4*a* is brought into contact with the panel 27, fitting the conductor portion 24 of the antennas male terminal 22 in the opening 12 of the side wall 4*b* such that the ring portion 25 of the antennas male terminal 22 is placed on the aperture of the panel 27. Thus, the ring portion 25, the panel opening, and the mounting aperture 6 are aligned, with the slits 25*a* and 6*a* also aligned. Then, the aperture 30 of the board 26 is aligned with the mounting aperture 6 of the housing base 4*a*. Then, planar clip 31 is inserted into the ring portion 25 and the mounting aperture 6 such that the head 31*c* fits in the slits 25*a* and 6*a* while the leg portion 31*a* comes into contact with the ground conductor of the board 26 with the return 31*b*. Then, the return 31*b* is soldered to the ground conductor to secure the male connector 2 and the board 26 to the panel 27.

Figure 13:
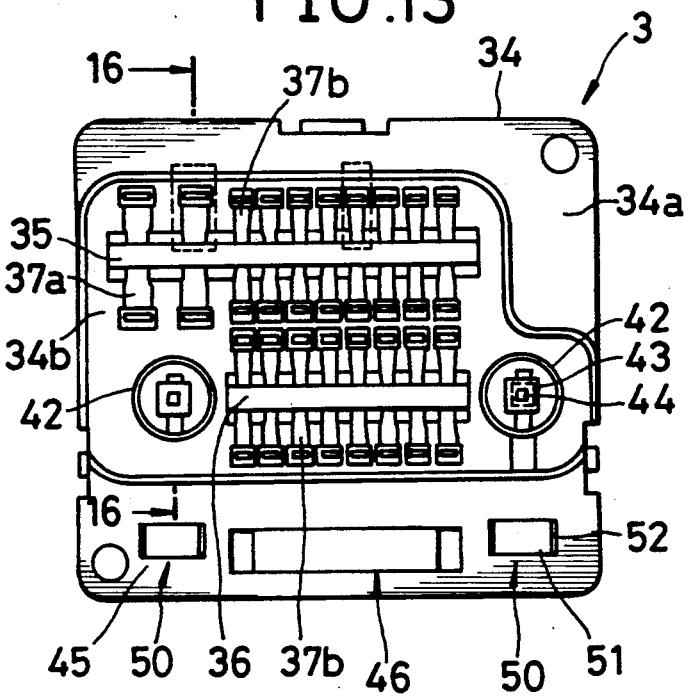
FIG. 13 is a top plan view of a female electrical connector according to an embodiment of the invention.
Figure 14:
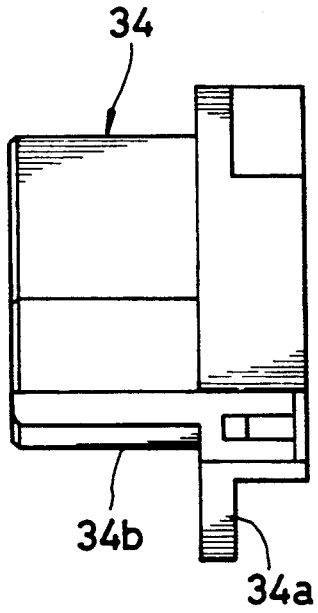
FIG. 14 is a side elevational view thereof.
Figure 15:
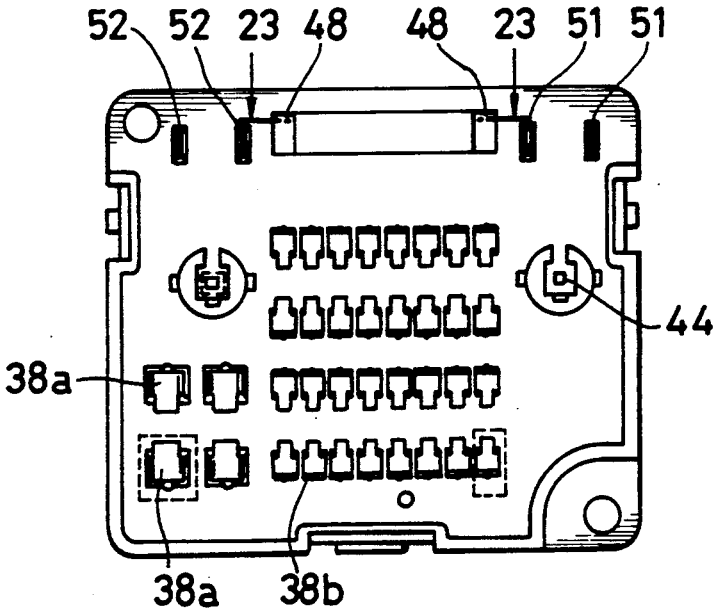
FIG. 15 is a bottom plan view thereof.

In FIGS. 13-15, the female connector 3 includes an insulation housing 34 which has a housing base 34*a* and a fitting block 34*b* with a long fitting recess 35 and a short fitting recess 36. Four power terminal channels 37*a* and 16 signal terminal channels 37*b* are formed on opposite sides of the long fitting recess 35 at predetermined intervals, and 16 signal terminal channels 37*b* are formed on opposite sides of the short fitting recess 36 at predetermined intervals. A pair of antennas terminal mounts 42 are formed across the short fitting recess 36 on the fitting block 34*b*. A cable bundling section 46 is formed on the center of a front portion 45 of the housing base 34*a*. A pair of terminal mounts 50 are formed across the cable bundling section 46. The terminal mount 50 has a rectangular recess 51 and a pair of slits 52 on opposite ends of the rectangular recess 51.

Figure 16:
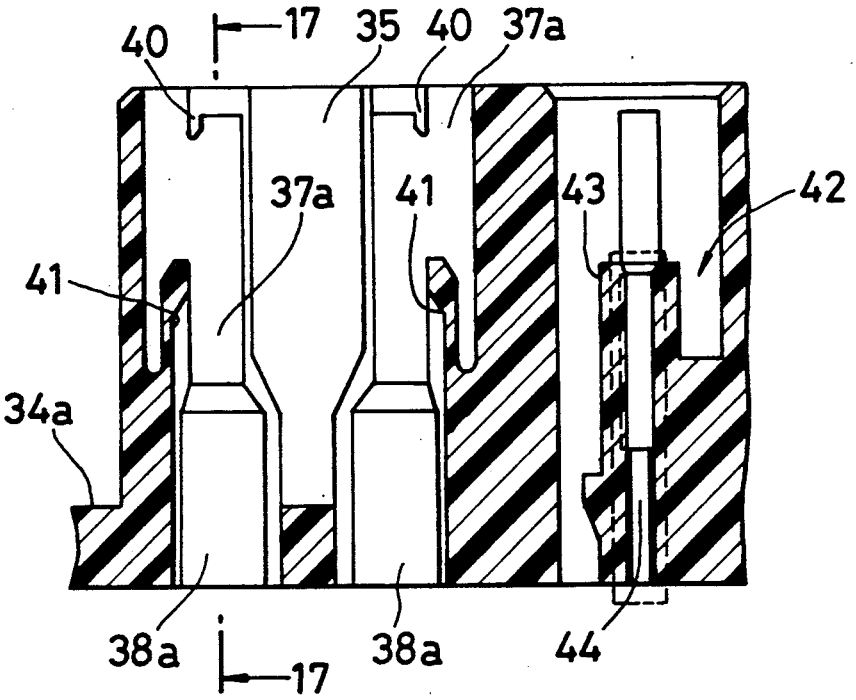
FIG. 16 is a sectional view taken along line 16—16 of FIG. 13.
Figure 17:
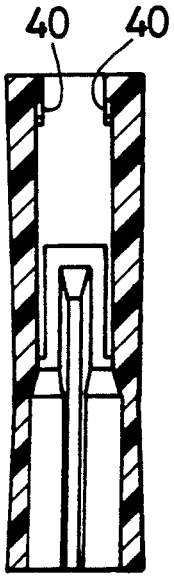
FIG. 17 is a sectional view taken along line 17—17 of FIG. 16.

In FIGS. 16 and 17, the terminal channels 37*a* communicate with terminal press fit apertures 38*a* at the bottom of the fitting recess 35. A pair of terminal supports 40 are provided at opposite sides of the front end of each terminal channel 37*a*. A lance 41 extends forwardly from the middle of each terminal channel 37*a*. The antennas terminal mounts 42 have a columnar portion 43 which has an antennas terminal receiving aperture 44.

Figure 18:
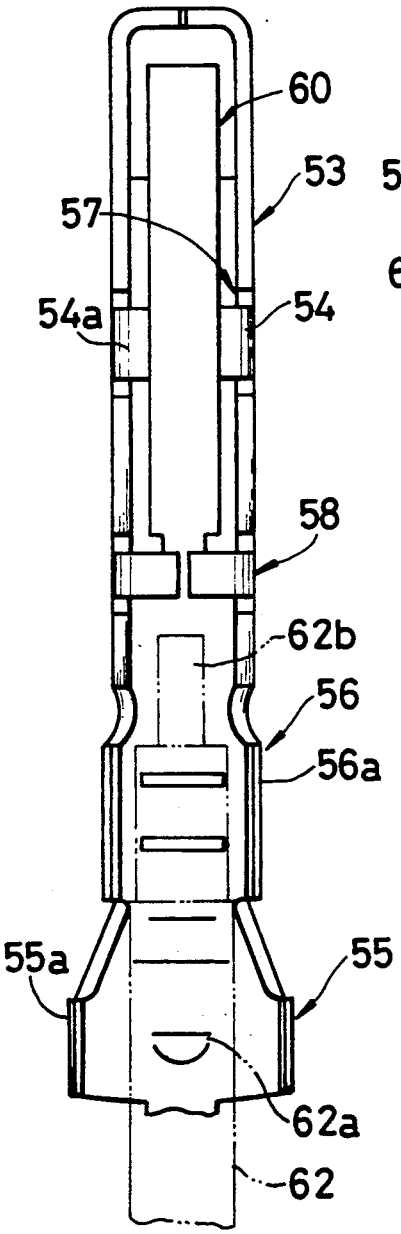
FIG. 18 is a top plan view of a female contact terminal for the female electrical connector.
Figure 19:
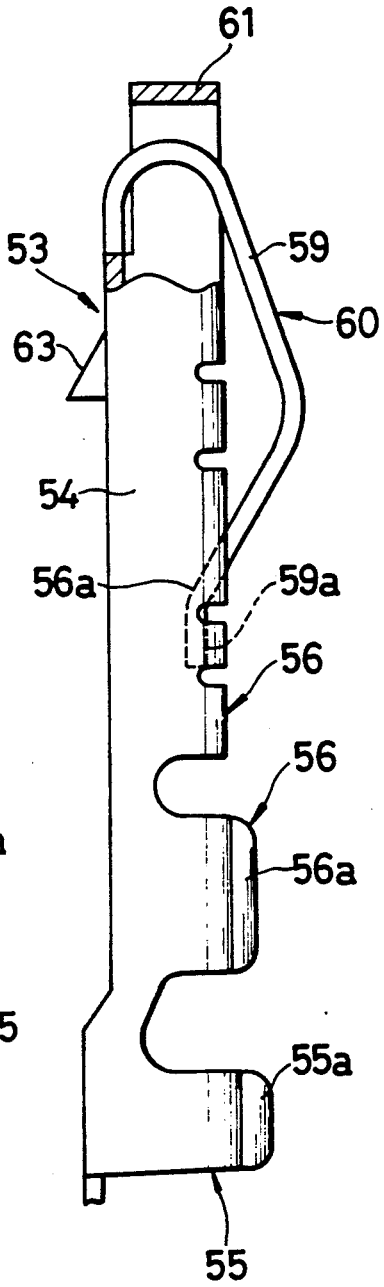
FIG. 19 is a side elevational view thereof.
Figure 20:
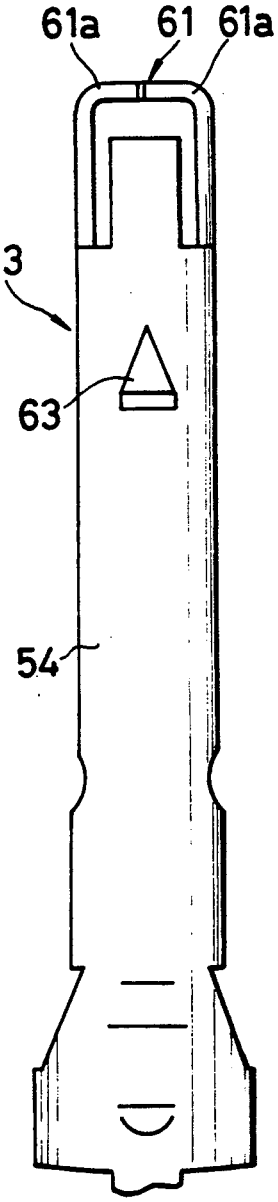
FIG. 20 is a bottom plan view thereof.

In FIGS. 18-20, a female terminal 53 has a substantially U-shaped terminal body 54 with a U-shaped sheath crimping portion 55 and a U-shaped central conductor crimping portion 56. The sheath crimping portion 55 has a pair of crimping tabs 55*a* while the central conductor crimping portion 56 has a pair of crimping tabs 56*a*. The terminal body 54 has a pair of bent pieces 54*a* to form a stopper portion 57 and a similarly structured hook portion 58. The front strip portion 59 of the terminal body 54 is bent backwardly and then downwardly to form a V-shaped contact portion 60. The free end 59*a* thereof is engages the hook portion 58. The front ends 61*a* of opposite sides of the terminal body 54 are bent to form a support portion 61 which surrounds the contact portion 60 for protection.

The sheath crimping portion 55 and the central conductor crimping portion 56 are crimped to the sheath 62*a* and the central conductor 62*b* of a signal line 62. The terminal is then inserted into the terminal channel 37*b* through the terminal press fit aperture 38*b* until the front support portion 61 abuts on the terminal support portion 40. The lance 41 engages with the projection 63 of the terminal body 53*a*. The signal lines 62 connected to the female terminals 53 are bundled with a band 74 of the cable bundling section 46 to be described later.

Figure 21:
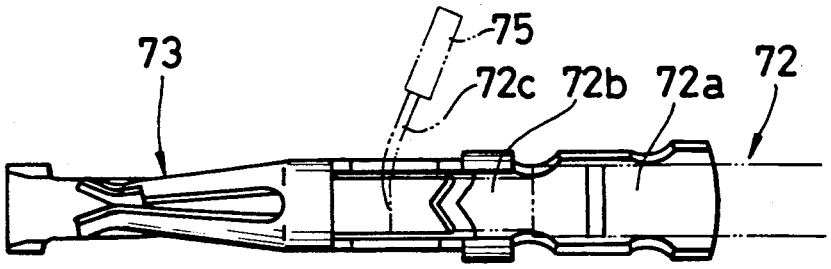
FIG. 21 is a top plan view of an antennas female contact terminal for the female electrical connector.
Figure 22:
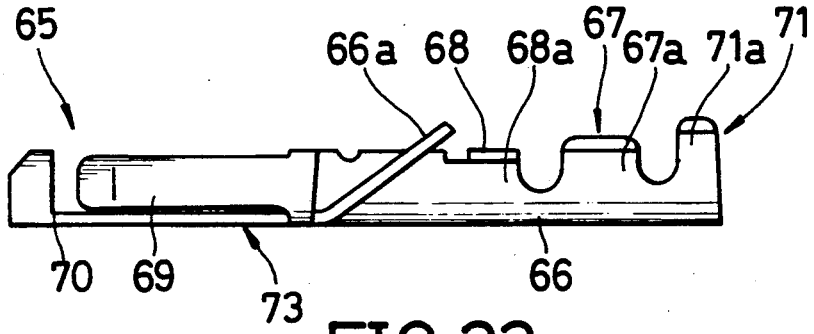
FIG. 22 is a side elevational view thereof.

In FIGS. 21 and 22, an antennas female terminal 65 has a terminal body 66 which has a U-shaped engaging portion 71, a U-shaped sheath crimping portion 67, and a U-shaped shield crimping portion 68. The engaging portion 71 has a pair of engaging tabs 71*a* while the sheath crimping portion 67 and the shield crimping portion 68 have a pair of crimping tabs 67*a* and 68*a*, respectively. A lance 66*a* extending upwardly and backwardly from the middle bottom of the terminal body 66. A pair of spring contact pieces 69 and 70 extend forwardly from the middle of the terminal body 66 to form a contact portion 73.

The sheath crimping portion 67 and the shield crimping portion 68 are crimped to the sheath 72 and the shield braid 72*b* to connect the antennas line 72 to the female terminal 65. The contact 75 is attached to the signal line 72*c* of the antennas line 72. The contact portion 73 of the antennas female terminal 65 and the contact 75 are inserted into the antennas terminal aperture 44 from the back of the housing 34, and the antennas terminal 65 is bent between the contact portion 73 and the shield crimping portion 68 so that the engaging edges 71*a* of terminal engaging portion 50. Then, the engaging edges 71*a* are bent into the recess 51 to affix the antennas female terminal 65 to the housing 34.

Figure 23:
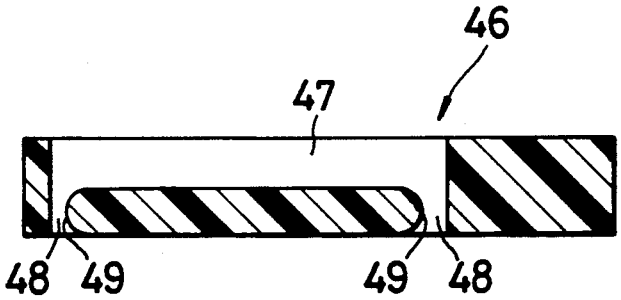
FIG. 23 is a sectional view taken along line 23—23 of FIG. 15.
Figure 24:
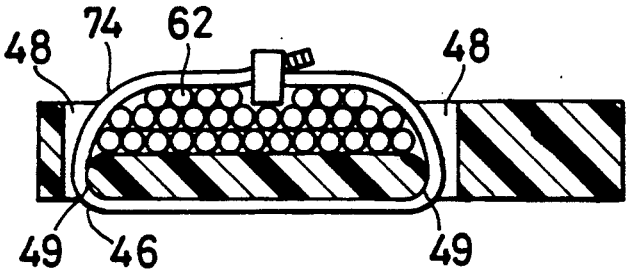
FIG. 24 is the sectional view showing how to bundle a number of cables on the female electrical connector.
Figure 25:
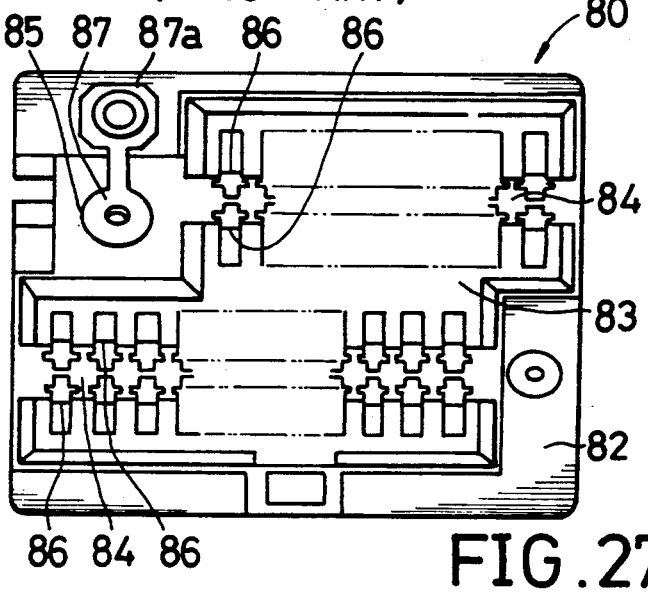
FIG. 25 (PRIOR ART)
FIG. 25 is a conventional male electrical connector.
Figure 26:
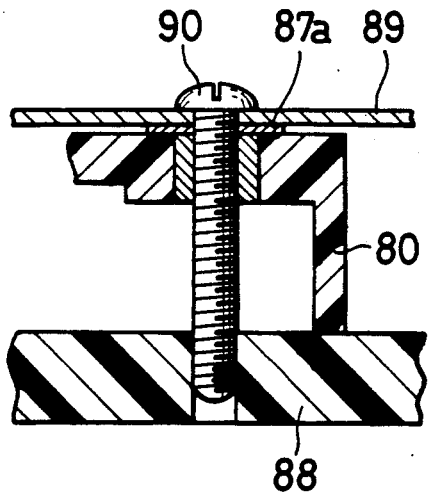
FIG. 26 (PRIOR ART)
FIG. 26 is a sectional view of a mounting aperture of the male electrical connector.
Figure 27:
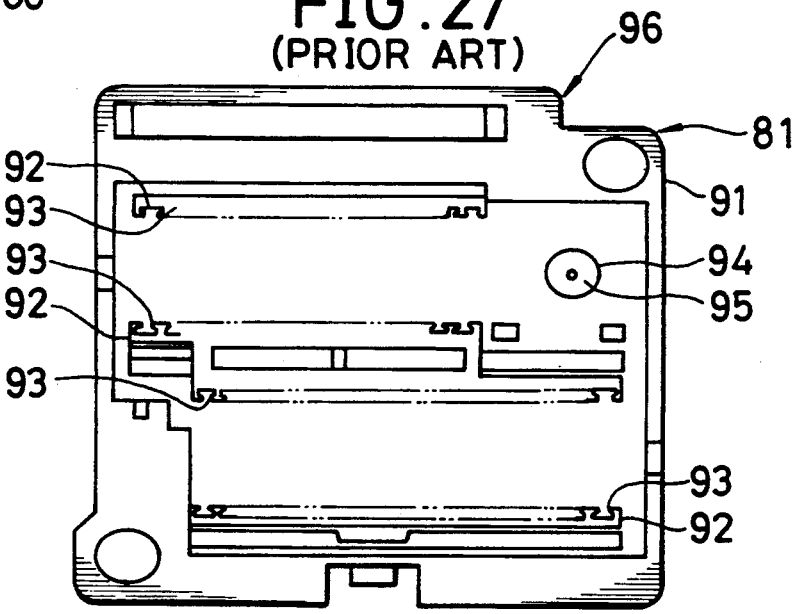
FIG. 27 (PRIOR ART)
FIG. 27 is a bottom plan view of a conventional female electrical connector.
Figure 28:
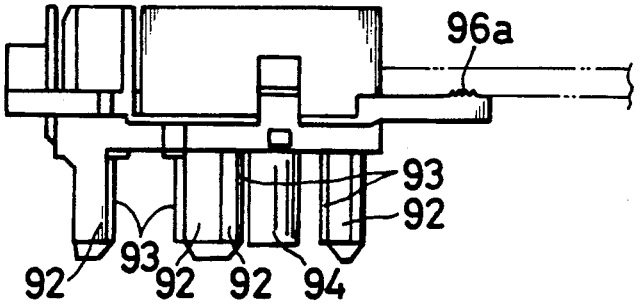
FIG. 28 (PRIOR ART)
FIG. 28 is a side elevational view thereof.

In FIG. 23, the cable bundling section 46 has a rectangular recess 47 and a pair of openings 48 opposite ends of the rectangular recess 47. The inner side 49 of the opening 48 is made in the form of a semi-circle. As FIG. 24 shows, the band 74 is passed through the apertures 48 to bind the signal lines bundled on the cable bundling section 46. The band 74 is bent along the semi-circular wall 49 so that the band does not become loose after being tightened.

The male connector 2 and female connector 3 thus constructed are connected by fitting the fitting block 34*b* of the female connector 3 into the fitting cavity 5 of the male connector 2 so that the signal terminals and power terminals of both the connectors are brought into contact with each other while the antennas female terminal 65 is brought into contact with the antennas male terminal 20.

Since the support portion 61 of the female terminal 53 is supported by the terminal supports 40 of the terminal aperture 38*b*, the female terminal 53 is prevented from flexing back upon contact with a mating male terminal 16, thereby increasing the contact pressure. The support portion 61 surrounds the front end of the contact portion 60 for protection. Since the stopper portion 57 is formed in the middle of the terminal body 54, the contact pieces 59 of the contact portion 60 is prevented by the stopper portion 57 from being deformed beyond the elastic limits by the mating male terminal 16, thus preventing plastic deformation of the contact pieces 59.

We claim:

1. An electrical connector comprising:

a male electrical connector having a plurality of male contact terminals and a plurality of male antenna connection terminals;

a female electrical connector having a plurality of female contact terminals for contact with said male contact terminals and a plurality of female antenna connection terminals for contact with said male antenna connection terminals;

means provided on the front end of said terminal aperture for supporting a front end of said female contact terminal; and said female contact terminals having a stopper portion in a middle portion thereof, a hook portion behind said stopper portion, a contact strip extending backwardly and upwardly from a front bottom end and then downwardly to form a V-shaped contact portion, with a free end of said contact strip engaged with said hook portion, and a front end supported by said means when said female contact terminal is fitted into said terminal aperture.

* * * * *